US006200188B1

(12) United States Patent
Filo

(10) Patent No.: US 6,200,188 B1
(45) Date of Patent: Mar. 13, 2001

(54) ELECTRONIC TOY SOLDIER APPARATUS

(76) Inventor: Andrew S. Filo, 22670 Oakcrest Ct., Cupertino, CA (US) 95014

( * ) Notice: Subject to any disclaimer, the term of this patent is extended or adjusted under 35 U.S.C. 154(b) by 0 days.

(21) Appl. No.: 09/478,366

(22) Filed: Jan. 6, 2000

(51) Int. Cl.[7] ..... A63H 30/00
(52) U.S. Cl. ..... 446/175; 446/297; 446/405
(58) Field of Search ..... 446/175, 405, 446/404, 398, 401, 325, 297

(56) References Cited

U.S. PATENT DOCUMENTS 3,064,390 * 11/1962 Barnes .
4,659,919 * 4/1987 Price ..... 446/297
4,675,519 * 6/1987 Price ..... 446/297
4,678,450 * 7/1987 Scolari et al. ..... 446/405
4,874,343 * 10/1989 Rosenthal ..... 446/175
5,073,140 * 12/1991 Lebensfeld et al. ..... 446/297
5,314,336 * 5/1994 Diamond et al. ..... 446/297
5,375,847 * 12/1994 Fromm et al. ..... 446/175
5,478,267 * 12/1995 McDonald et al. ..... 446/15
5,648,753 * 7/1997 Martin ..... 446/484
5,668,333 * 9/1997 Horton et al. ..... 446/175
5,989,091 * 11/1999 Rodgers ..... 446/153

* cited by examiner

*Primary Examiner*—Kien T. Nguyen
(74) *Attorney, Agent, or Firm*—Alfred F. Hoyte, Jr.

(57) ABSTRACT

A toy soldier apparatus includes a toy soldier replica which may support three different simulated firearms. The replica has an electronic circuit contained therein, the electronic circuit including a speaker driver for driving a speaker which is contained within the replica. Connected to the electronic circuit is an optical sensor, which is preferably connected within the eye socket of the replica, and is disguised to appear as one of the replica's eyes. A switch on the replica's body is operably connected to the electronic circuit to allow the user to selectively choose between several operating modes for the apparatus. The different operating modes may be chosen so that the sound emanating from the simulated weapon correspond to the real sounds which emanate from the weapon. Once the operating mode is chosen, the optical sensor may cause activation of the speaker driver to simulate the sound of a weapon firing in response to movement.

8 Claims, 7 Drawing Sheets

| | TG2 ON | TG2 OFF | AUDIBLE REPLY |
|---|---|---|---|
| POWER ON | X | X | NO SOUND |
| | X | X | NO SOUND |
| PRESS TG1 | X | X | "SEMI " |
| | X | | SINGLE SHOT |
| PRESS TG1 (TWICE) | X | X | "AUTO" |
| | X | | MULTIPLE SHOTS |
| PRESS TG1 (3 TIMES) | X | X | "LAUNCHER" |
| | X | | LAUNCHER SOUND |

ELECTRONIC TOY SOLDIER APPARATUS

BACKGROUND OF THE INVENTION

The present invention relates to an electronic toy soldier. More particularly, it relates to an interactive electronic toy soldier which can give varied responses to selected stimuli.

Statement of the Prior Art

Prior art interactive toys generally fall into two large categories. The first is the video game, where "virtual" characters or icons are manipulated in response to changing scenarios presented on a computer monitor or television screen. The second category is dolls and other figurines which may have various means for generating a response. For instance, a baby doll which giggles when its mid-section is depressed.

Toy soldiers have been used by children for many years but only relatively recently have the toy soldiers incorporated any type of electronic circuitry. This circuitry may include some type of speech generating circuitry but typically only generates a single sound or sounds. The sound may be intermittent or generated in response to a push button.

SUMMARY OF THE INVENTION

The present invention contemplates an interactive toy soldier apparatus. The toy soldier apparatus includes a toy soldier replica which may support different simulated firearms in a recreational tactical combat situation. The replica has an electronic circuit contained therein, the electronic circuit including a speaker driver for driving a speaker which is contained within the replica. Connected to the electronic circuit is an optical sensor, which is preferably connected and aligned within the eye socket of the replica, and is disguised to appear as one of the replica's eyes. A switch on the replica's body is operably connected to the electronic circuit to allow the user to selectively choose between several operating modes for the apparatus. The different operating modes may be chosen so that the sound emanating from the replica's body correspond to the real sounds which emanate from the weapon. Once the operating mode is chosen, the optical sensor may cause activation of the speaker driver to simulate the sound of a weapon firing in response to movement in the "field of view" of the toy soldier replica.

Accordingly, it is a principal object of the invention to provide a new and improved toy soldier apparatus.

Accordingly, it is an object of the invention to provide an improved toy soldier apparatus which can simulate the sound of several weapons.

It is another object of the invention to provide an improved toy soldier apparatus having an optical sensor circuit which can sense movement in the field of view of the toy soldier replica.

It is another object of the invention to provide an improved toy soldier apparatus having programmable electronic circuitry responsive to signals from the optical sensor circuit contained therein.

It is another object of the invention to provide an improved toy soldier apparatus where all of the electronic circuits and power supply are contained within the body of the doll.

Finally, it is a general object of the invention to provide improved elements and arrangements thereof in an apparatus for the purposes described which is robust, reliable, and fully effective in accomplishing its intended purposes of simulating tactical combat situations.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
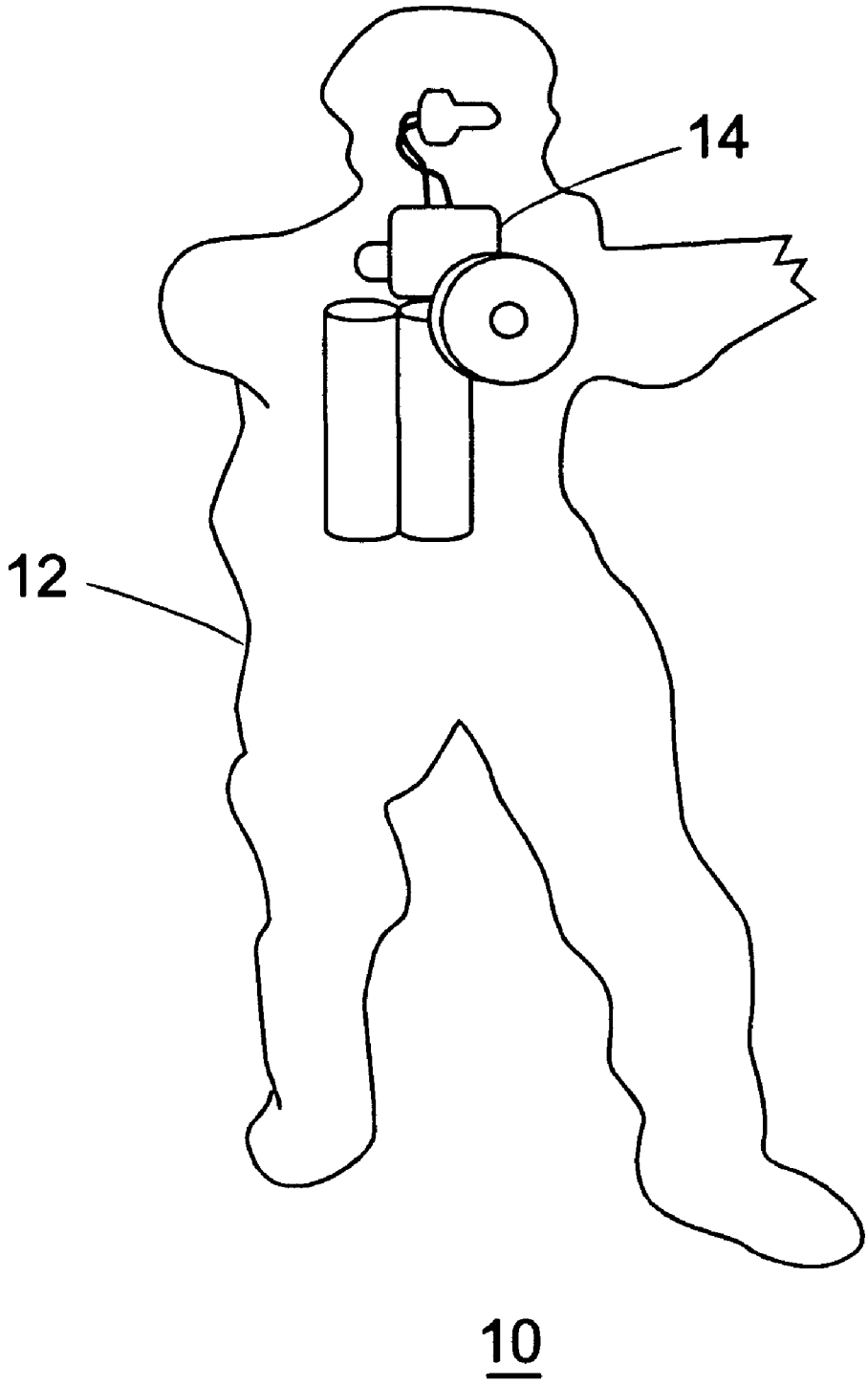
FIG. 1 shows a partially broken away perspective view of the toy soldier apparatus of the present invention.

Referring now to FIGS. 1–7, the toy soldier apparatus of the present invention, generally indicated by the numeral 10, is shown. The apparatus 10 has three basic components, the replica of a toy soldier or housing 12, the electronic circuitry 14 including the power supply 14, and the weapon 16.

The replica 12 is made of plastic or other suitable material and should be large enough so that the torso 18 is sufficiently large to contain a suitable power supply 20, the power supply 20 preferably being a pair of AAA cells. Alternatively, a rechargeable power supply may be used. The torso 18 is hollow and has separable half portions 22, 24 which include mating prongs 26 and corresponding receptacles 28 to facilitate alignment of the two halves 22, 24. Contained within and secured to the rear 24 half portion of the torso 18 is a housing 30 for the electronic circuitry 14. Speaker 32, switch 34, and photocell 36 are operatively connected to the circuitry 14 as will be explained in more detail later. An optical system includes a cylindrical connector 40 containing a fiber optic 42 which is attached to the photocell 36 for focusing ambient light onto the photocell 36. The distal end 44 of the fiber optic 42 is shaped to look like an eye so it can be inserted into eye socket 46 of the head 48 of the replica 12. Alternatively, an aperture centrally located in a simulated eye (not shown) may be shaped like an iris of an eye for an even more realistic look. The distal end 44 is shaped to focus the light received from an area reasonably similar to a realistic field of view. Optics, not shown, may be used to accomplish this, alternatively, the distal end 44 is optically shaped to gather light in accordance with a field of view pattern. A battery receptacle 50 is secured to the rear half 24 of the torso 18 by a pair of screws 52, 54, the receptacle 50 including spring loaded battery contacts 56 as is well known in the art. An access door 60 is hingedly connected to the rear half 24 of the torso 18 to allow for easy replacement of the batteries 20.

The weapon 16 is aligned with the field of view of the optical system as described above so that when an object disrupts or comes within the filed of view, the circuit 14 will be activated.

Indentations 62, 64 are formed in the torso 18 to create a socket 65 when the torso halves 22, 24 are assembled. The socket 65 is sized to frictionally engage a ball joint 66 connected to one end of the arms 68. The legs 70 are connected using a similar arrangement, and may include a hinged foot portion 72. A male bayonet type connector 74 extends from the top portion of the torso 18 and lockingly engages with an appropriately sized female receptacle 76 in the head 48.

Figures 2, 8:
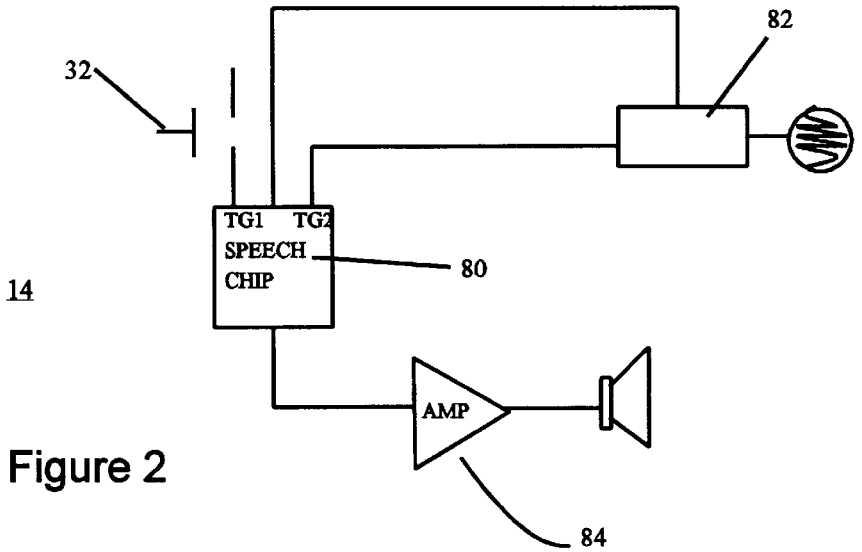
FIG. 2 shows a functional block diagram of the electronic circuit contained within the toy soldier apparatus.
FIG. 8 shows a truth table detailing the logic states of the electronic circuit shown in FIGS. 2 and 3.
Figure 3:
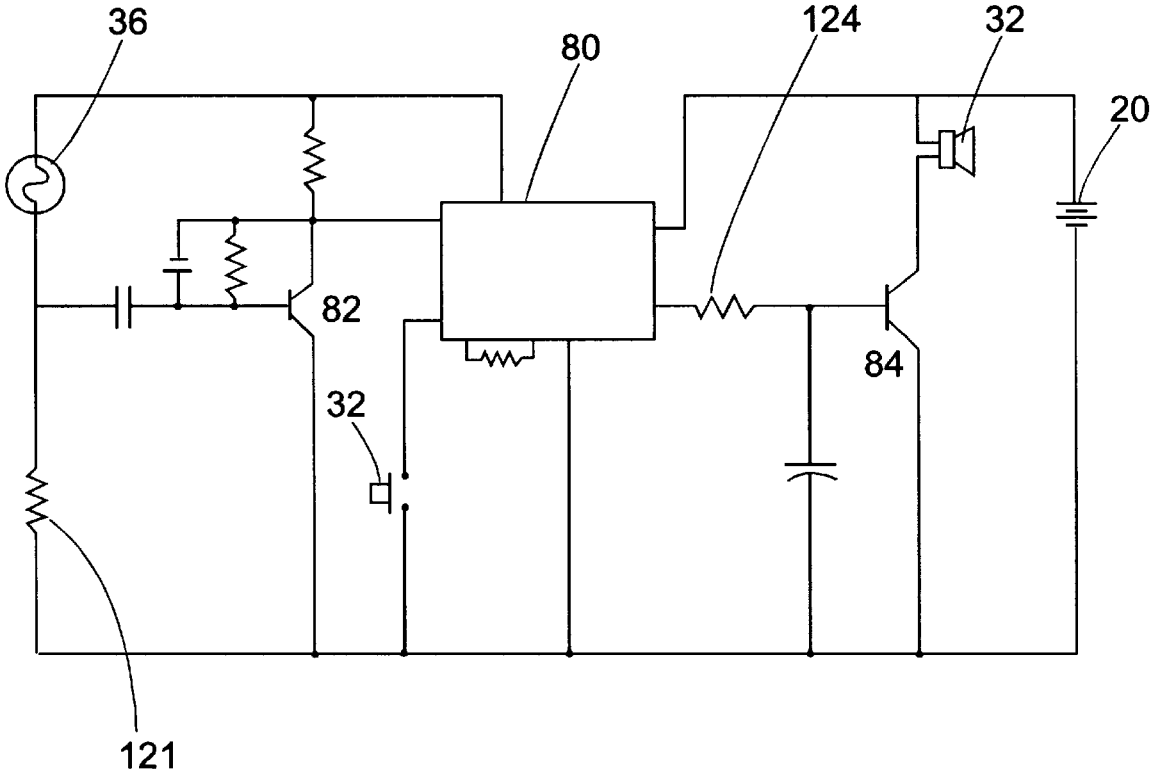
FIG. 3 shows a detailed circuit diagram of the electronic circuit contained within the toy soldier apparatus.

Referring now to FIGS. 2 and 3, the electronic circuit 14 has five major components. A microprocessor chip 80, photocell 36 and associated processing circuitry 82, switch 32, and speaker driver 84. Power for the microprocessor 80 is supplied by power cell 20 to the Vcc pin, and may be about 3 volts. Two inputs are supplied to the microprocessor 80, the output from the photocell 36 and associated circuitry or light sensor circuit 82, and the impulse from the switch 32 which is generated by a user depressing the switch. The microprocessor 80 outputs a signal to drive the speaker in accordance with the operational mode selected by the user. The photocell may be a CdS photo cell which is connected to a node N1. Also connected to node N1 is resistor R1, which may be 100 k ohms, the other end of R1 being connected to ground. A 10 $\mu$f capacitor C1 is connected to node N1, the other terminal of the capacitor C1 connected to an RC circuit, C2, R2, which momentarily forward biases transistor T2 thereby sending a signal to microprocessor 80. Of course, R2 and C2 are chosen in accordance with the time desired to forward bias the transistor T2. R2 may be 100 k ohms, with C2 set at 0.01 $\mu$f Normally off transistor T2 has its output connected to pin TG1. Switch 32 is connected between pin TG0 and ground. The output of microprocessor 80 is connected to a transistor driving circuit containing 10 ohm resistor R4 and 0.1 $\mu$f capacitor C3, the transistor T1 serving to amplify the audio signal generated by the microprocessor 80. The speaker 32 is connected to transistor T1 to output the audio sound generated by the microprocessor 80.

Figure 4:
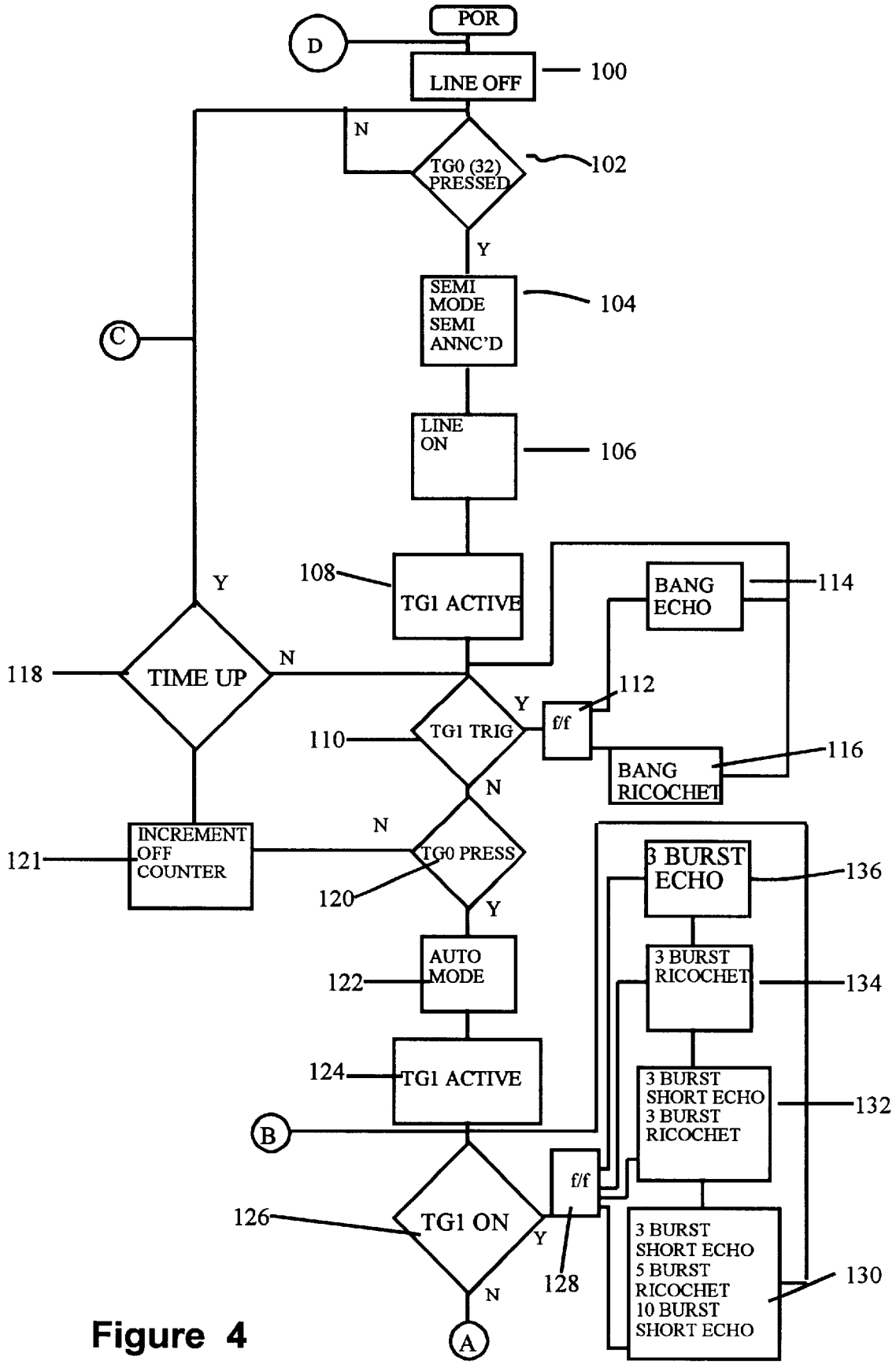
FIG. 4 shows a portion of a flowchart detailing the operation of the electronic circuit contained within the toy soldier apparatus.
Figure 5:
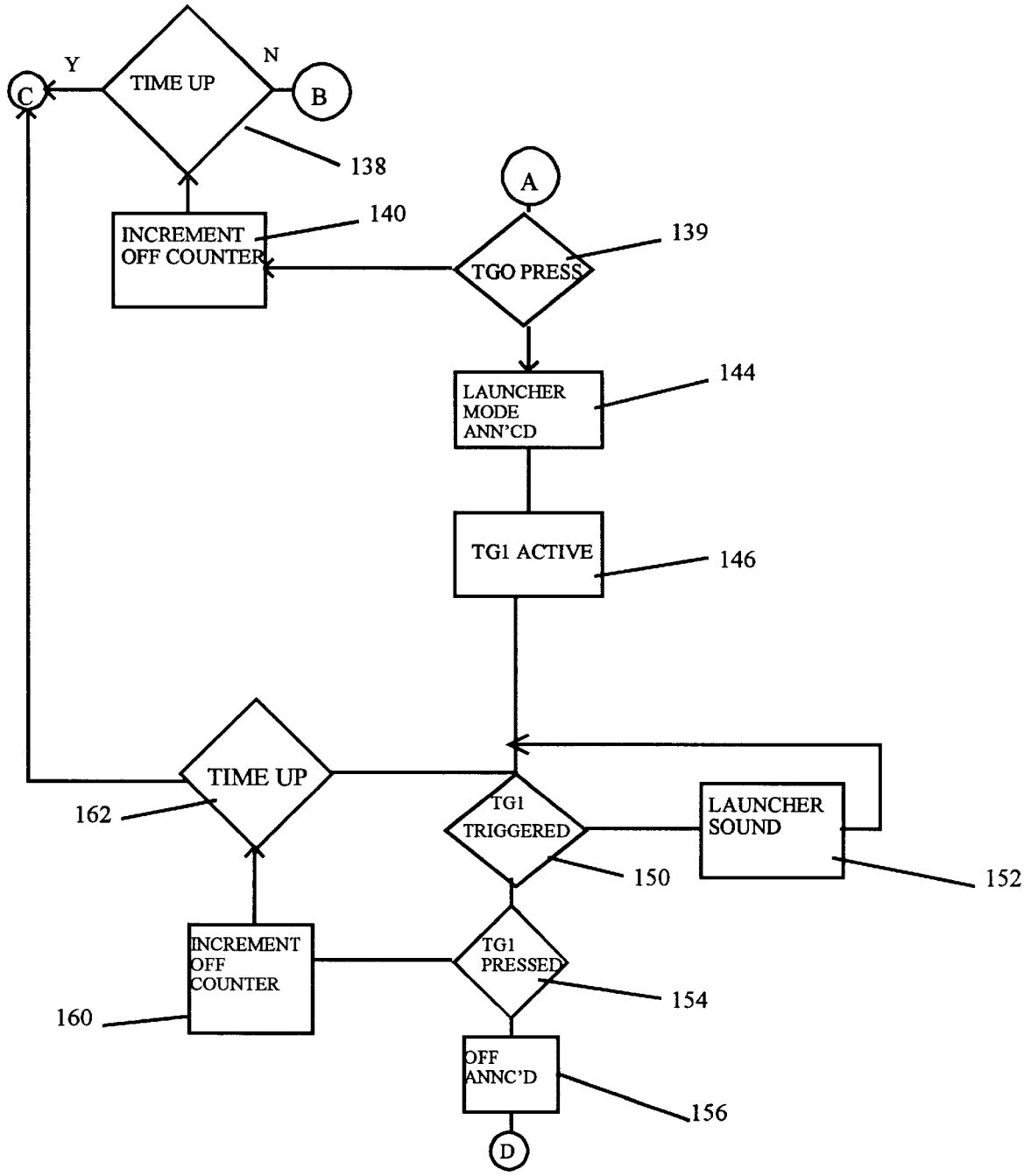
FIG. 5. shows another portion of a flowchart detailing the operation of the electronic circuit contained within the toy soldier apparatus.
Figure 6:
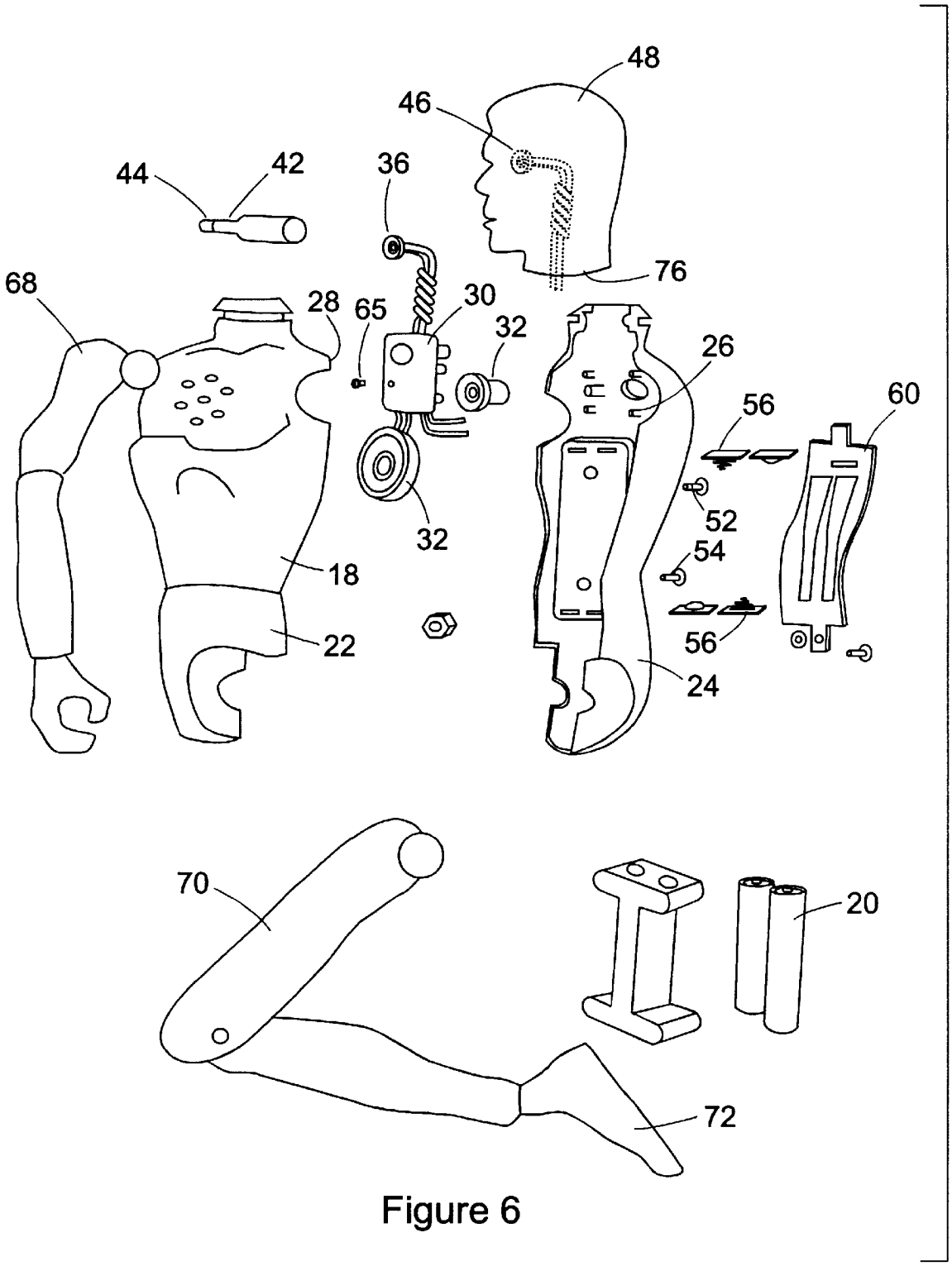
FIG. 6 shows an exploded perspective view of the housing of the toy soldier apparatus.
Figure 7:
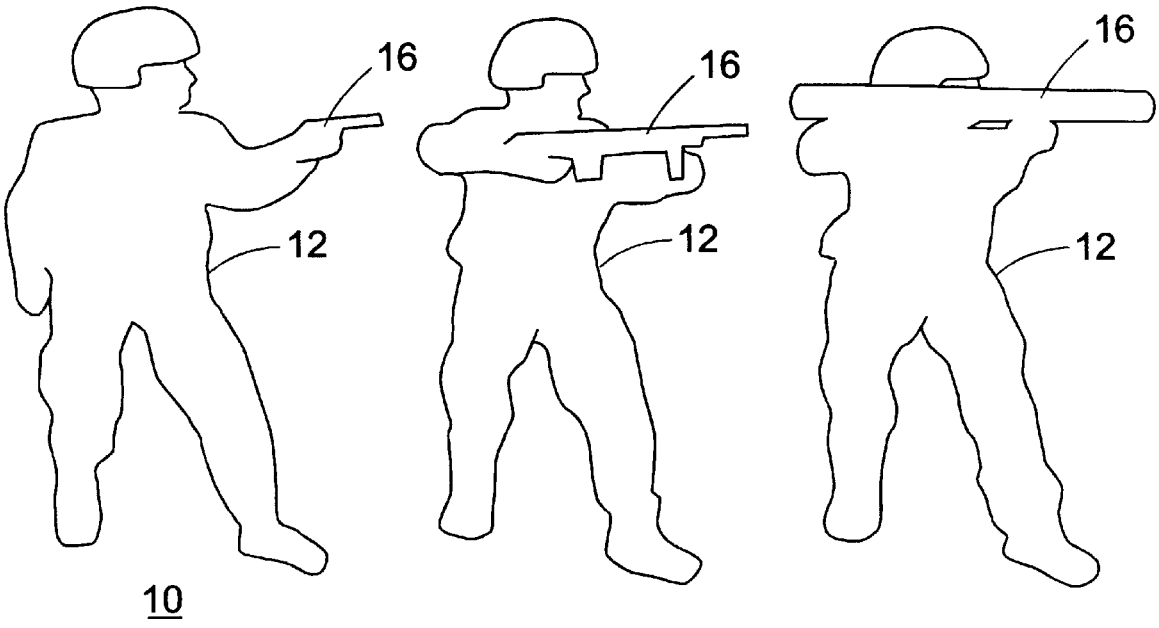
FIG. 7 shows partially broken away perspective views of the toy soldier housing with various weapon configurations.

The operation of the circuit 14 is detailed in the flowcharts and truth table shown in FIGS. 4, 5, and 8. The circuit 14 is initially off, conserving battery power. If switch 32 has been depressed once and the light sensor circuit 82 has been activated, then a flag is set and the appropriate sound effects are generated as is indicated in blocks 102–116. The steps indicated in blocks 110–116 are repeated so long as the light sensor circuit 82 indicates movement which interrupts or changes the light sensed by the photocell 36. If the switch 32 has been depressed once and the light sensor circuit 82 has not been activated for a predetermined amount of time, a time out condition occurs and the program loops back to decision block 102, after checking to see if the switch 32 has been depressed a second time as seen in block 120. Otherwise, the off counter is incremented as seen in block 121 and the circuit 14 remains active, awaiting a signal from the light sensor circuit. If the switch has been depressed a second time and the light sensor circuit 82 has been activated, then a flag is set and the appropriate sound effects are generated as is indicated in blocks 120–136. Again, the steps indicated in blocks 120–136 are repeated so long as the light sensor circuit 82 indicates movement which interrupts or changes the light sensed by the photocell 36. If desired a light source such as a flashlight (not shown) may be may be positioned to illuminate photocell 36, to provide a more dramatic voltage shift for photocell 36 and to ensure triggering of the light sensor circuit 82 in the event that an object comes between photocell 36 and the light source. Such an arrangement may also be used for testing purposes. It should be noted that a motion sensor or noise sensor may also be used to sense movement in the field of view of the replica 12. If the switch 32 has been depressed twice and the light sensor circuit 82 has not been activated for a predetermined amount of time, a time out condition occurs and the program loops back to decision block 102 after checking to see if the switch 32 has been depressed a third time as seen in block 139. Otherwise, the off counter is incremented as seen in block 140 and the circuit 14 remains active, awaiting a signal from the light sensor circuit 82. If the switch 32 has been depressed a third time, and the light sensor circuit 82 has been activated, then a flag is set and the appropriate sound effects are generated as is indicated in blocks 144–152. If the switch is depressed a fourth time, the circuit 14 is turned off as indicated in blocks 154, 156, and 100. If the switch 32 has been depressed three times and the light sensor circuit 82 has not been activated for a predetermined amount of time, a time out condition occurs and the program loops back to decision block 102 after checking to see if the switch 32 has been depressed a fourth time as seen in block 139. Otherwise, the off counter is incremented as seen in block 160 and the circuit 14 remains active, awaiting a signal from the light sensor circuit 82.

The operation of the circuit 14 is summarized in the truth table. With the power on, and no signal sent from the light sensor circuit 82, no sound is generated by the speech chip 80, which is the nominal standby state. With the power on and the switch 32 (TG1) depressed once, the circuit 14 is in the "semi" mode corresponding to the doll 12 firing a miniature semi-automatic 16. If the light sensor circuit 82 outputs a signal (TG2 on), then the speech chip 80 outputs one of three single shot sounds, each in a different key, with a ricochet sound after the third shot. This produces a non-repetitive pattern that closely emulates actual firing sounds. With the switch 32 pressed a second time, the circuit 14 is in the auto mode, and the circuit outputs the single shot sound 10, 5, and 3 times in a staccato fashion to emulate a machine gun. Finally, if the circuit 14 is in the launcher mode corresponding to the switch 32 being depressed a third time, the single shot sound is played around 30% slower to emulate a launcher and the impact of the launcher. It should be noted that the operation of the light sensor circuit 82 may be facilitated by providing a light source (not shown) to shine directly on the photocell 36. The circuit 82 may then be activated when the beam from the light source is broken or otherwise interrupted.

From the foregoing description, one skilled in the art can easily ascertain the essential characteristics of this invention and, without departing from the spirit and scope thereof, can make various changes and modifications of the invention to adapt it to various usages and conditions.

It is to be understood that the present invention is not limited to the sole embodiment described above, but encompasses any and all embodiments within the scope of the following claims:

What is claimed is:

1. A toy soldier apparatus comprising:

a replica of a soldier having a hollow torso portion and supporting any selected one of a plurality of types of simulated weapons;

electronic circuitry substantially contained within said torso portion;

sensing means connected to said electronic circuitry and contained within said replica for sensing a change in ambient light surrounding said replica;

audio means connected to said electronic circuitry for outputting an audible signal corresponding to the selected one of said plurality of types of simulated weapons, wherein said electronic circuitry includes a single activation/mode selection switch, said switch connected to a time out circuit for interrupting power to said electronic circuitry after a predetermined time.

2. The apparatus of claim 1 wherein said electronic circuitry includes switching means allowing a user to select the audible signal output by said audio means.

3. The apparatus of claim 1 wherein said sensing means is an optical system having a field of view that is aligned with a line of fire of the simulated weapon.

4. The apparatus of claim 1 wherein said audible signal for a first of said types of simulated weapons is a simulated single gunshot sound.

5. The apparatus of claim 4 wherein said audible signal for a third of said types of simulated weapons is a simulated rocket launch and blast sound, said simulated rocket launch and blast sound created by extending the duration of the audible signal representing the single gunshot sound.

6. The apparatus of claim 1 wherein said audible signal for a second of said types of simulated weapons is a a simulated volley of gunshot sounds.

7. The apparatus of claim 1 wherein said replica has a head portion containing a pair of eyes and a fiber optic element extending to at least one of said eyes, said fiber optic element serving to focus the ambient light from the area surrounding said replica onto a light sensing element.

8. The apparatus of claim 1 wherein said audible signal is transduced from a single electrical signal which may be contained within memory means contained within said electronic circuitry, said single electrical signal capable of manipulation by said electronic circuitry to produce the audible signal corresponding to the selected one of said plurality of types of simulated weapons.

* * * * *